US006281178B1

(12) United States Patent
Ryklin et al.

(10) Patent No.: US 6,281,178 B1
(45) Date of Patent: Aug. 28, 2001

(54) REDUCED RESIDUE HARD SURFACE CLEANER COMPRISING HYDROTROPE

(75) Inventors: Irma Ryklin, Buffalo Grove; Arshad Malik, Mundelein, both of IL (US)

(73) Assignee: Stepan Company, Northfield, IL (US)

( * ) Notice: Subject to any disclaimer, the term of this patent is extended or adjusted under 35 U.S.C. 154(b) by 0 days.

(21) Appl. No.: 09/410,724

(22) Filed: Oct. 1, 1999

Related U.S. Application Data

(63) Continuation of application No. 08/945,060, filed as application No. PCT/US97/02107 on Feb. 13, 1997, now abandoned.

(60) Provisional application No. 60/011,661, filed on Feb. 14, 1996.

(51) Int. Cl.[7] ..... C11D 9/04

(52) U.S. Cl. ..... 510/181; 510/180; 510/179

(58) Field of Search ..... 510/180, 121, 510/182, 179, 163

(56) References Cited

U.S. PATENT DOCUMENTS

| | | | | |
|---|---|---|---|---|
| H269 | * | 5/1987 | Malik | 422/37 |
| H468 | * | 5/1988 | Malik et al. | 252/37 |

(List continued on next page.)

FOREIGN PATENT DOCUMENTS

| | | |
|---|---|---|
| 1295912 | 2/1992 | (CA) . |
| 0 009 193 A1 | 4/1980 | (EP) . |
| 0 040 882 A1 | 12/1981 | (EP) . |
| 0 080 749 A1 | 6/1983 | (EP) . |
| 0 105 063 A1 | 4/1984 | (EP) . |
| 0 467 618 A1 | 1/1992 | (EP) . |
| 0 595 383 A1 | 5/1994 | (EP) . |
| 0 636 687 A2 | 2/1995 | (EP) . |
| 260887 | 11/1926 | (GB) . |
| 2 160 887 | 1/1986 | (GB) . |
| 2 166 153 | 4/1986 | (GB) . |
| WO 93/15173 | 8/1993 | (WO) . |
| WO 93/20176 | 10/1993 | (WO) . |
| WO 93/23513 | 11/1993 | (WO) . |
| WO 94/10272 | 5/1994 | (WO) . |
| WO 94/23003 | 10/1994 | (WO) . |
| WO 97/30140 | 8/1997 | (WO) . |

OTHER PUBLICATIONS

The Journal of American Oil Chemists Society, 1975, 52:323–329.

Joseph C. Drozd, Proc. World Conf. Oleochem., pp. 256–268 (1991) "Use of Sulfonated Methyl Esters in Household Cleaning Products".

(List continued on next page.)

*Primary Examiner*—Gregory Delcotto
*Assistant Examiner*—John M Petruncio
(74) *Attorney, Agent, or Firm*—McDonnell Boehnen Hulbert & Berghoff; Steven J. Sarussi

(57) ABSTRACT

Disclosed are aqueous hard surface cleaning compositions comprising detergent surfactant and, optionally, detergent builder and a hydrotrope in an amount sufficient to prevent filming and/or streaking after a surface is cleaned with the compostions.

15 Claims, 1 Drawing Sheet

U.S. PATENT DOCUMENTS

| | | | | |
|---|---|---|---|---|
| 2,129,264 | | 9/1938 | Downing et al. . | |
| 2,178,353 | | 10/1939 | Werntz . | |
| 2,774,786 | | 12/1956 | Erickson . | |
| 2,813,898 | | 11/1957 | Gaertner . | |
| 2,828,332 | | 3/1958 | Gaertner . | |
| 3,294,693 | | 12/1966 | Dupre et al. . | |
| 3,309,319 | | 3/1967 | Coward et al. . | |
| 3,318,817 | | 5/1967 | Smith, Jr. . | |
| 3,679,608 | | 7/1972 | Aubert et al. . | |
| 3,882,038 | | 5/1975 | Clayton et al. . | |
| 3,933,671 | | 1/1976 | Heile . | |
| 3,970,594 | | 7/1976 | Claybaugh . | |
| 4,137,190 | | 1/1979 | Chakrabarti et al. . | |
| 4,152,306 | | 5/1979 | DeMatteo, Jr. . | |
| 4,287,080 | | 9/1981 | Siklosi . | |
| 4,343,725 | | 8/1982 | Kiewert et al. . | |
| 4,414,128 | | 11/1983 | Goffinet . | |
| 4,448,704 | | 5/1984 | Barby et al. . | |
| 4,565,647 | | 1/1986 | Llenado . | |
| 4,606,842 | | 8/1986 | Keyes et al. . | |
| 4,627,931 | * | 12/1986 | Malik | 252/153 |
| 4,690,779 | | 9/1987 | Baker et al. . | |
| 4,943,392 | | 7/1990 | Hastedt et al. . | |
| 5,108,660 | | 4/1992 | Michael . | |
| 5,126,068 | | 6/1992 | Burke et al. . | |
| 5,252,245 | | 10/1993 | Garabedian, Jr. et al. . | |
| 5,290,472 | | 3/1994 | Michael . | |
| 5,342,549 | | 8/1994 | Michael . | |
| 5,389,283 | | 2/1995 | Held, III . | |
| 5,531,933 | | 7/1996 | Masters et al. . | |
| 5,707,948 | * | 1/1998 | Evers et al. . | |
| 5,726,139 | | 3/1998 | Willey et al. . | |
| 5,750,482 | * | 5/1998 | Cummings | 510/182 |
| 5,817,615 | | 10/1998 | Garabedian, Jr. et al. . | |

OTHER PUBLICATIONS

Milwidsky, B.M, Hard Surface Cleaners, Happi, 25, 78–97, (1988).

Whalley, G.R., A Look at Hard Surface Cleaners, Happi, 31, 92–94, (1994).

Dahanayake, M., and Kristoff, W., Phosphate Ester Hydrotropes, Happi, 29, 150–152, (1992).

Neuberg, C., Biochem J. 76, 107, (1916).

Balasubramanian, D. Aggregation Behavior of Hydrotropic Compounds in Aqueous Solutions, J. Phys. Chem., 93, 3865–70, (1989).

Rath, H. Tenside, 2, 1, (1965). (A translation of the summary is located on p. 5.).

Mirgorod, Y.A. and Kulibaba, N.S., Kolloidn, Th. 41, 461, (1979). (A translation of the summary is located on the last page.).

Ward, A.J., The Mechanism of Hydrotrope Action in Aqueous Nonionic Surfactant System, J. Dispersion Science Technology, 9, 149–69, (1988).

Frisberg, S.E. and Chiu, M., Hydrotropes, J. Dispersion Science Technology, 9, 443–57, (1989).

Schulz, P.C., Thermal Transitions in Surfactant–Based Hydrotropic Liquid Crystals, Thermochimica Acta, 231, 239–56, (1994).

* cited by examiner

REDUCED RESIDUE HARD SURFACE CLEANER COMPRISING HYDROTROPE

This is a continuation of application Ser. No. 08/945,060, filed Jan. 2, 1998, abandoned which is a continuation of PCT/US97/02107, filed Feb. 13, 1997, which is a continuation of Ser. No. 60/011,661 filed Feb. 14, 1996.

BACKGROUND OF THE INVENTION

1. Field of the Invention

The invention relates to a non-rinse, isotropic hard surface cleaner especially adapted to be used on glossy or smooth, hard surfaces, such as glass windows and the like, which removes soils deposited thereon, while significantly reducing the amount of residue caused by unremoved soil, cleaner, or a combination thereof. More specifically, the present invention relates to a compositions for cleaning hard surfaces that contain a hydrotropic compounds and methods for preparing such compositions. It further relates to compositions for cleaning hard surfaces with significant levels of builders.

2. Description of the Prior Art

To remove soils deposited on such surfaces such as glass or ceramic tile, the typical approach has been to use an alkaline ammonium-based aqueous cleaner or other aqueous cleaners containing various mixtures of surfactants and other cleaning additives. Unfortunately, many of the ammonia-based cleaners have fairly poor soil removing ability, while many of the surfactant-based cleaners leave fairly significant amounts of residue on such hard, glossy surfaces. This residue is seen in the phenomena of streaking, in which the soil, cleaner, or both are inconsistently wicked off the surface, and filming, in which a thin layer of the residue actually clings to the surface desired to be cleaned.

Aqueous cleaning compositions for hard surfaces have been disclosed that contain various special ingredients said to aid in the performance of the cleaner in order to have reasonable cleaning performance with reduced filming or streaking.

U.S. Pat. No. 4,606,842 discloses a composition for cleaning glass and similar glossy hard surfaces which contains polyacrylic resins which may be comprised of a polyacrylic acid or a mixture of polyacrylic acid and an acrylic polymer complex with a phosphonate or sulfur containing moiety which is used as a builder in an aqueous composition which also includes an organic solvent system and at least one detergent surface active agent.

U.S. Pat. No. 4,690,779 discloses a hard surface cleaning composition chain polymers of polyacrylic acid in combination with certain non-ionic surfactants which function together as hard surface cleaners.

U.S. Pat. No. 5,126,068 discloses the use of certain ethylene oxide/propylene oxide polymer surfactants, and organic surfactants in combination with certain polycarboxylic builders as cleaning ingredients in hard surface cleaners with reduced filming/streaking qualities.

U.S. Pat. No. 4,343,725 discloses an aqueous base cleanser for glass mirrors and reflecting surfaces which is free of detergent builders and organic solvents and contains a water soluble non-ionic polyoxyethylene glycol polymer having a molecular weight between 300,000 and 4,000,000.

U.S. Pat. No. 4,943,392 discloses aqueous detergent compositions suitable for general purpose household cleaning compositions or hard surfaces wherein the main ingredient is butoxypropanol.

U.S. Pat. No. 5,252,245 discloses an aqueous hard surface cleaner with improved residue removal and reduced filming/streaking containing solvents selected from the group consisting of $C_{1-6}$ alkanol, $C_{3-24}$ alkylene glycol ether, amphoteric and anionic surfactants, a buffering system and fragrance.

Aqueous cleaning compositions of the prior art have disadvantages. They frequently contain little or no detergent or builder salts and therefor tend to have poor cleaning performance.

There is a need for the incorporation of high levels of builders and surfactants in a hard surface cleaners to increase the cleaning performance while maintaining low filming and streaking.

SUMMARY OF THE INVENTION

Hydrotropes have been employed in hard surface cleaners to maintain product stability or homogeneity over wide temperature ranges. The amount used is the minimum required to achieve the requisite stability or homogeneity of the cleaner. No practical or economic advantage has been associated with using an amount of hydrotrope in excess of the minimum required to provide a stable cleaner.

It has now been discovered that the incorporation of a hydrotropic compound in a, preferably aqueous based, hard surface cleaner unexpectedly provides reduced filming and streaking on cleaned surfaces when the hydrotropic compound is incorporated into the composition in a specific ratio to the other solids.

Thus, in one aspect, the invention provides hard surface cleaners that include various surfactants, builders, optional solvents, etc, and a hydrotropic compound such that the ratio of the weight of hydrotropic compound to the sum of the weights of the remaining solids is at least about 1:3.5.

In another aspect, the invention also provides improved hard surface cleaners comprising an detergent base and a hydrotropic compound where the weight ratio of hydrotropic compound to the weight of builder(s) in the detergent base is at least about 1:1.8.

The compositions of the invention may be dry, i.e., powdered, or may be liquid, i.e., aqueous or organic solvent based. Of course, dry compositions must be added to either water or other liquid prior to use in cleaning hard surfaces.

The detergent base of the hard surface cleaners of the invention comprises a detergency surfactant and a detergent builder. Optional components include solvents, alkanolamines, soaps, as well as fragrance, coloring agents, brighteners, etc.

In another aspect, the invention also encompasses methods for preparing hard surface cleaners capable of excellent cleaning of a hard surface without leaving a visible residue. These methods include adding an amount of a hydrotrope effective to inhibit a filming or streaking effect on the surface.

The invention provides methods and compositions having reduced filming which results from a residue of cleaner, soil, or both remaining on the hard surface intended to be cleaned.

Thus, this invention improves overall cleaning performance by adding to a hard surface cleaner an amount of a hydrotrope effective to reduce the visibility of hard surface cleaner residues, and thus filming and streaking.

The invention further provides cleaners for glass and other hard, glossy surfaces, which has virtually no filming or streaking.

In another aspect, the invention provides hard surface cleaners containing antibacterial or germicidal quaternary ammonium compounds; such compositions are capable of cleaning a hard surface while simultaneously removing or killing bacteria. These compositions provide excellent cleaning and disinfecting of a hard surface while leaving no visible residue or streaks.

DETAILED DESCRIPTION OF THE INVENTION

Figure 1:
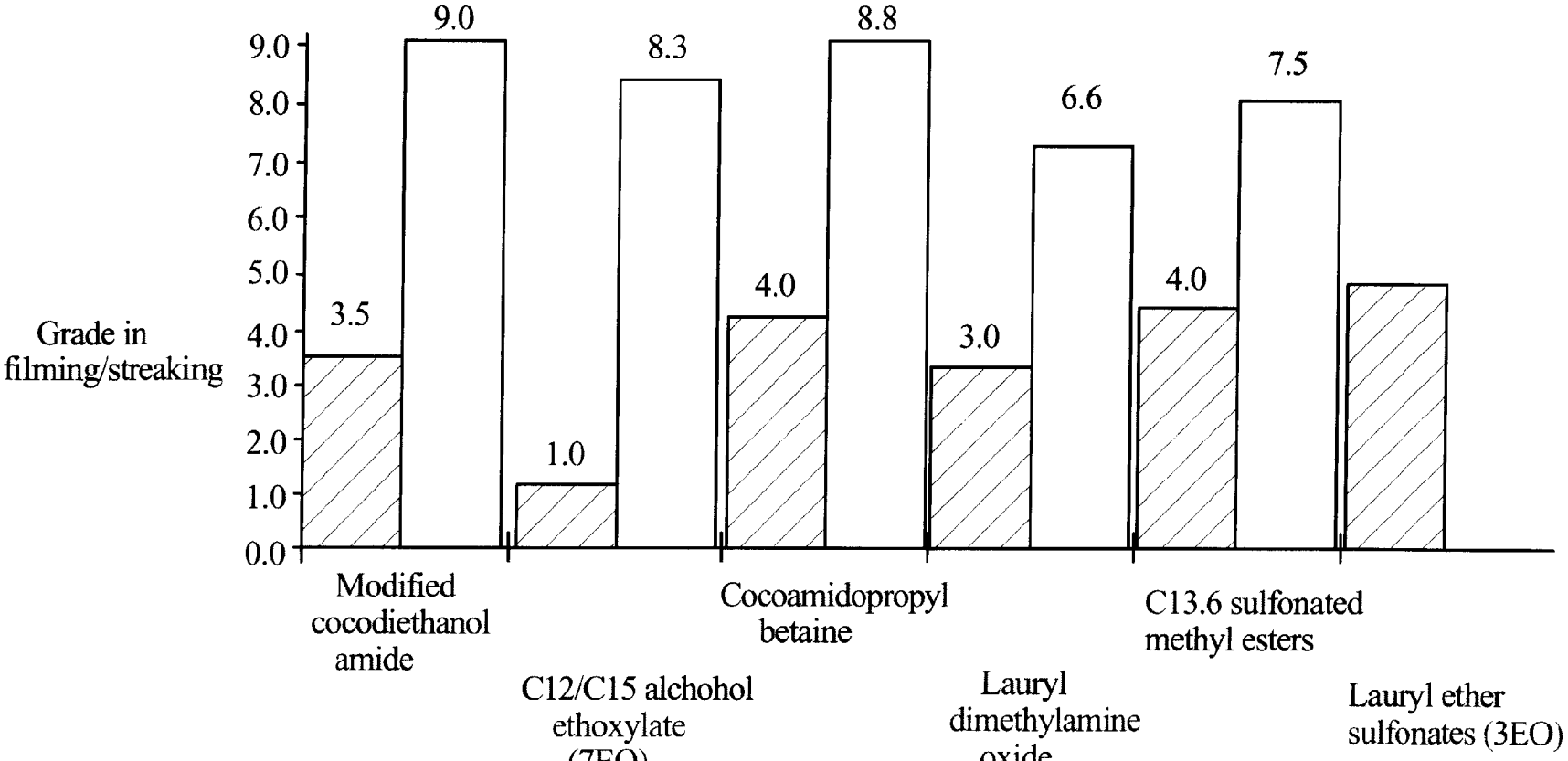
FIG. 1 is a set of bar graphs showing the improvement yielded by adding an inventive amount of hydrotrope to various aqueous hard surface cleaner formulations based on different surfactant materials. Open bars represent compositions comprising an effective amount of hydrotrope according to the invention required to prevent filming and streaking and solid bars represent formulations without such an amount of hydrotrope. The larger numbers represent less filming on a scale of 1 to 10.

It has now been discovered that incorporating a sufficient amount of a hydrotropic compound in a hard surface cleaner, preferably an aqueous based hard surface cleaner, unexpectedly provides reduced filming and streaking on cleaned surfaces. In the inventive compositions, the hydrotropic compound is incorporated in a ratio of the weight of hydrotropic compound to the weight of all solids exclusive of hydrotropes of from about 1:3.5 to 4:1. In addition, in certain compositions, the ratio of hydrotrope to builder is from about 1:1.8 to 4:1.

In more preferred embodiments of the invention, the ratio of hydrotrope to other solids is from about 1:2.5 to 2.5:1. In particularly preferred embodiments of the invention, the ratio of hydrotrope to other solids is from about 1:2 to 2:1.

Where the composition is a antibacterial composition, the composition preferably comprises a quaternary ammonium germicide, an alkyl polyglucoside, and a $C_{8-16}$ amine oxide. More preferably, such a composition contains 0.01–5% by weight of a quaternary ammonium germicide, from about 0.5 to 5% by weight of an alkyl polyglucoside, and from about 0.5 to 5% by weight of a $C_{8-16}$ amine oxide. Most preferably, such a composition also includes ethylenediamine tetraacetate.

As used herein the terms "hydrotrope" and "hydrotropic compound" refer to benzene sulfonates, naphthalene sulfonates, short chain ($C_{1-11}$) alkyl benzene sulfonates, medium chain ($C_{6-11}$) alkyl sulfonates, medium chain ($C_{6-11}$) alkyl sulfates, alkylpolyglucosides, medium chain ($C_6$–$C_{10}$) alkyl dimethyl amine oxides, alkyl diphenyloxide disulfonates, phosphate ester hydrotropes, and medium chain ($C_{6-11}$) alkyl ether (up to 10 moles of ethylene oxide) sulfates. The cations of the hydrotropic compounds of the invention include alkali metal, ammonium, and triethanolammonium cations. Thus, these terms include short-chain water-soluble surfactants which comprise a hydrophilic substituent and one or more hydrophobic hydrocarbyl substituents wherein the maximum chain length of any of said hydrocarbyl substituents is about $C_{11}$.

Short chain ($C_{1-4}$) alkyl benzene sulfonates include, for example, isopropylbenzene sulfonates, xylene sulfonates, toluene sulfonates, cumene sulfonates, and mixtures thereof.

Representative, non-limiting examples of medium chain ($C_{6-8}$) alkyl sulfonates are hexyl sulfonates, octyl sulfonates, and hexyl/octyl sulfonates, and mixtures thereof. Other hydrotropes are naphthalene sulfonates.

The terms "hydrotrope" and "hydrotropic compound" also refer to alkylpolysaccharides such as alkylpolyglycosides, polymeric hydrotropes, $C_{8-10}$ amine oxides, alkyldiphenyloxide disulfonates, and phosphate esters such as isopropanol alkyl phosphate esters, and the like.

Preferred hydrotropes for use in the invention are xylene sulfonates, cumene sulfonates, alkyl sulfonates having from an average of about 6–8 carbon atoms in the alkyl portion, and alkylpolyglycosides having an average of about 10 carbon atoms in the alkyl portion. A preferred alkylpolyglysoside is alkylpolyglucoside.

Suitable alkylpolysaccharides, such as those disclosed in U.S. Pat. No. 4,565,647, are nonionic surfactants and include those having a hydrophobic group and a polysaccharide, e.g., a polyglucoside, hydrophilic group containing from about 1.3 to about 10, preferably from about 1.3 to about 3, most preferably from about 1.3 to about 2.7 saccharide units. Any reducing saccharide containing 5 or 6 carbon atoms can be used, e.g., glucose, galactose and galactosyl moieties can be substituted for the glucosyl moieties. (Optionally the hydrophobic group is attached at the 2-, 3-, 4-, etc. positions thus giving a glucose or galactose as opposed to a glucoside or galactoside.) The intersaccharide bonds can be, e.g., between the one position of the additional saccharide units and the 2-, 3-, 4-, and/or 6-positions on the preceding saccharide units.

Suitable polymeric hydrotropes are described in European Patent Publication 0636687 A2, the disclosure of which is incorporated herein in its entirety. The polymeric hydrotropes suitable for use herein include those having the formula:

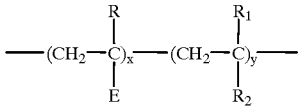

where

E is a hydrophilic functional group;

R is H or $C_{1-10}$ alkyl or is a hydrophilic functional group;

$R_1$ is a lower alkyl group or aromatic group; and $R_2$ is H or a cyclic, alkyl, or aromatic group.

The present invention thus provides liquid detergent compositions which provide excellent shine performance together with improved cleaning characteristics both on greasy, oily soils and on inorganic particulate soils with little tendency to cause filming or streaking on washed surfaces.

Aqueous liquid cleaners are used full strength or may be further diluted with water by the consumer to clean a wide variety of hard surfaces.

The uses for such cleaning liquids are too numerous to be specified completely, but such compositions can be combined, for example, with water, and used for cleaning of painted surfaces, walls, floors, appliance exterior surfaces, tables, chairs, windows, mirrors, and so forth. Such compositions are normally formulated to a concentration of roughly 1% to about 20%, calculated by weight of all nonaqueous components, in water. Such compositions are included within the present definition of hard surface cleaners. The compositions of the invention typically have the following ingredients and proportions.

First, such liquid cleaners contain from 0.05% to 20% of a suitable surfactant. Successively more preferred ranges of surfactant inclusion are from 1% to 10% of a surfactant, and from 2% to 5% of a surfactant. Broadly, the surfactants useful for formulation of hard surface cleaners are those in the broad surfactant disclosure below.

Another required component of the cleaners, preferably aqueous liquid cleaners, of the present invention is 0.01% to 20% of a builder salt. Any of the builders or inorganic salts described below may be used herein as builders.

The hard surface cleaners, preferably aqueous cleaners, of the invention may include a variety of optional ingredients, as more fully discussed below.

In aqueous systems, the balance of the composition (1–99%) is water, preferably soft water in order to minimize the initial load on the sequestering builders.

A further discussion of the requirements and formulation of liquid cleaners is found in U.S. Pat. Nos. 3,679,608, issued to Aubert et al. on Jul. 25, 1972, and 3,970,594, issued to Claybaugh on Jul. 20, 1976. The foregoing two patents are hereby incorporated by reference herein.

The Detergent Surfactant

Liquid cleaners according to the invention contain from about 0.1% to about 40% of suitable detergent surfactant. Successively more preferred ranges of surfactant inclusion are from about 1% to about 10% of surfactant, and from about 2% to about 5% of surfactant. Broadly, the surfactants useful for formulation of aqueous liquid cleaners are the usual ones for hard surface cleaners. Some specific surfactants are those in the broad surfactant disclosure of U.S. Pat. No. 4,287,020, Siklosi, issued Sep. 1, 1981, incorporated herein by reference in its entirety.

The detergent surfactant falls into the following classes: anionic, cationic, nonionic, zwitterionic and amphoteric surfactants, and mixture thereof. Cationic, zwitterionic, nonionic, and amphoteric surfactants are well known in the art; examples of such surfactants can be found in U.S. Pat. No. 4,287,080, Siklosi, incorporated by reference hereinabove.

Suitable surfactants for use in such cleaners are, for example, one or more of the following: sodium linear alkyl benzene sulfonate (LAS), particularly $C_{12-14}$ LAS; the sodium salt of a coconut alkyl ether sulfate containing 3 moles of ethylene oxide; the adducts of primary, secondary, and tertiary alcohols having a range of alkyl chain lengths of from 11 to 15 carbon atoms and an average of 2 to 12 ethylene oxide moieties; the sodium and potassium salts of coconut fatty acids (coconut soaps); the condensation product of a straight or branched chain alcohol containing from about 8 carbons to about 16 carbon atoms and having an average carbon chain length of from about 8 to about 12 carbon atoms with from about 2 to about 8 moles of ethylene oxide per mole of alcohol; an amide having one of the preferred formulas:

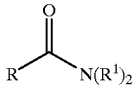

wherein R is a straight-chain alkyl group containing from about 7 to about 15 carbon atoms and having an average carbon chain length of from about 9 to about 13 carbon atoms and wherein each $R^1$ is a hydroxy alkyl group containing from 1 to about 3 carbon atoms or a hydroxyalkyl group ethoxylated with up to about 6 moles of ethylene oxide; a zwitterionic surfactant having one of the preferred formulas in the broad surfactant disclosure above; or a phosphine oxide surfactant having one of the preferred formulas in the broad disclosure of semipolar nonionic surfactants. Another preferred class of surfactants is the fluorocarbon surfactants, examples of which are FC-129, a potassium fluorinated alkylcarboxylate and FC-170-C, a mixture of fluorinated alkyl polyoxyethylene ethanols, both available from 3M Corporation, as well as the Zonyl fluorosurfactants, available from DuPont Corporation. It is understood that mixtures of various surfactants may be used.

Suitable examples of surfactants for use in the invention also include alpha-sulfonated alkyl esters. These materials may be pure alkyl esters or blends of (1) a mono-salt of an alpha-sulfonated alkyl eater of a fatty acid having from 8–20 carbon atoms where the alkyl portion forming the ester is straight or branched chain alkyl of 1–6 carbon atoms and (2) a di-salt of an alpha-sulfonated fatty acid, the ratio of mono-salt to di-salt being at least about 2:1. The alpha-sulfonated alkyl esters suitable for use in the invention are typically prepared by sulfonating an alkyl ester of a fatty acid with a sulfonating agent such as $SO_3$. When prepared in this manner, the alpha-sulfonated alkyl esters normally contain a minor amount, not exceeding 33% by weight, of the di-salt of the alpha-sulfonated fatty acid which results from hydrolysis of the ester. Preferred alpha-sulfonated alkyl esters contain less than about 10% by weight of the di-salt of the corresponding alpha-sulfonated fatty acid.

The alpha-sulfonated alkyl esters, i.e., alkyl ester sulfonate surfactants, include linear esters of $C_8$–$C_{20}$ carboxylic acid (i.e., fatty acids) which are sulfonated with gaseous $SO_3$ according to the "The Journal of American Oil Chemists Society," 52 (1975), pp. 323–329. Suitable starting materials would include natural fatty substances as derived from tallow, palm oil, coconut etc.

The preferred alkyl ester sulfonate surfactants comprise alkyl ester sulfonate surfactants of the structural formula:

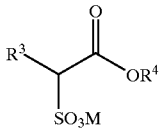

wherein $R_3$ is a $C_8$–$C_{20}$ hydrocarbyl, preferably an alkyl, or combination thereof, $R_4$ is a straight or branched chain $C_1$–$C_6$ hydrocarbyl, preferably an alkyl, or combination thereof, and M is a cation which forms a water soluble salt with the alkyl ester sulfonate. Suitable salt-forming cations include metals such as calcium, magnesium, sodium, potassium, and lithium, and substituted or unsubstituted ammonium cations, such as monoethanol amine, diethanolamine, and triethanolamine. Preferably, $R_3$ is $C_{10}$–$C_{16}$ alkyl, and $R_4$ is methyl, ethyl or isopropyl. More preferred are alpha-sulfonated methyl esters of mixtures of fatty acids having an average of from 12 to 16 carbon atoms. Most preferred are alpha-sulfonated methyl and ethyl esters of mixtures of fatty acids having an average of from about 12 to 14 carbon atoms. A particularly preferred mixture has an average of about 13.6 carbon atoms in the fatty acid portion.

For many purposes, synthetic (e.g., nonsoap) detergent surfactants are desirable. Suitable synthetic surfactants are described in U.S. Pat. No. 4,287,080, which is incorporated herein in its entirety.

Ampholytic and amphoteric detergents are also useful herein. Ampholytic synthetic detergents can be broadly described as derivatives of aliphatic amines which contain a long chain of about 8 to 18 carbon atoms and an anionic water-solubilizing group, e.g., carboxy, sulfo or sulfato. Examples of compounds falling within this definition are sodium 3-dodecylamino-propionate, sodium-3-dodecylamino propane sulfonate, and dodecyl dimethylammonium hexanoate. Other examples of ampholytic and amphoteric surfactants are found in U.S. Pat. No. 3,318,817, issued to Cunningham on May 9, 1967, and hereby incorporated herein by reference.

Zwitterionic surface active agents operable in the instant composition are broadly described as internally-neutralized derivatives of aliphatic quaternary ammonium, phosphonium and tertiary sulfonium compounds, in which the aliphatic radical can be straight chain or branched, and wherein one of the aliphatic substituents contains from about 8 to 18 carbon atoms and one contains an anionic water-solubilizing group, e.g., carboxy, sulfo, sulfato, phosphate, or phosphono. Some of these zwitterionic surfactants are described in the following U.S. Pat. Nos.: 2,129,264; 2,178,353; 2,774,786; 2,813,898; and 2,828,332. The ammonio-propane sulfonates containing about 8 to about 21 carbon atoms are one class of surfactant compounds preferred herein by virtue of their relatively low calcium ion (hardness) sensitivity.

The specific preferred examples of zwitterionic surfactants are those having the formula:

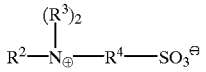

wherein $R^2$ contains from about 8 to about 16 carbon atoms and has an average of from about 10 to about 13 carbon atoms, each $R^3$ is selected from the group consisting of alkyl and hydroxy alkyl groups containing from 1 to about 3 carbon atoms, and $R^4$ is a saturated alkylene or hydroxy alkylene group containing from 2 to about 5 carbon atoms and wherein the hydroxy group in said hydroxyalkylene group is attached to a carbon atom which is separated from the nitrogen atom by at least one methylene group.

The water-soluble betaine surfactants are another example of a zwitterionic surfactant useful herein. These materials have the general formula:

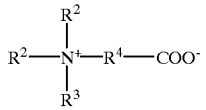

wherein $R^1$ is an alkyl group containing from about 8 to 18 carbon atoms; $R^2$ and $R^3$ are each lower alkyl groups containing from about 1 to 4 carbon atoms, and $R^4$ is an alkylene group selected from the group consisting of methylene, propylene, butylene and pentylene.

Examples of suitable betaine compounds of this type include dodecyldimethylammonium acetate, tetradecyldimethyl-ammonium acetate, hexadecyldimethylammonium acetate, alkyl-dimethylammonium acetate wherein the alkyl group averages about 14.8 carbon atoms in length, dodecyldimethylammonium butanoate, tetradecyl-dimethylammonium butanoate, hexadecyldimethyl-ammonium butanoate, dodecyldimethylammonium hexanoate, hexadecyl-dimethyl-ammonium hexanoate, tetradecyldimethyl-ammonium pentanoate and tetra-decyldipropyl ammonium pentanoate. Especially preferred betaine surfactants include dodecyldimethylammonium acetate, dodecyldimethylammonium hexanoate, hexadecyldimethylammonium acetate, and hexadecyldimethylammonium hexanoate.

Suitable cationic detergents are those having the formula $RN(R_2)_3^{\blacklozenge}\ X^-$ wherein R is an alkyl chain containing from about 8 to about 20 carbon atoms, and each $R_2$ is selected from the group consisting of alkyl and alkanol groups containing from 1 to 4 carbon atoms and benzyl groups there being normally no more than one benzyl group. Two $R_2$ groups can be joined by either a carbon-carbon ether, or imino linkage to form a ring structure. X represents a halogen atom, sulfate group, nitrate group or other pseudohalogen group. Specific examples are coconut alkyl trimethyl amine chloride, dodecyl dimethyl benzyl bromide, and dodecyl methyl morpholino chloride.

The Detergent Builder

Detergent builders, i.e., builder salts, are essential to the aqueous cleansers described herein and comprise from about 0.01% to about 30% by weight of the composition, preferably from 1% to about 20% by weight, and more preferably from about 5% to about 20% by weight of the aqueous compositions. The suitable builders are water-soluble or water-dispersible in nature and comprise organic and inorganic salts. Mixtures of organic and inorganic salts can be employed.

Suitable inorganic alkaline builder salts which can be used in this invention alone or in admixture include alkali metal carbonates, borates, pyrophosphates, orthophosphates, polyphosphates, phosphonates, bicarbonates, polyacetates, carboxylates, polycarboxylates, polyacetyl carboxylates, carboxymethyloxysuccinates, carboxymethyloxymalonates, ethylene diamine-N,N-discuccinic acid salts, polyepoxysuccinates, oxydiacetates, triethylene tetramine hexacetic acid salts, N-alkyl imino diacetates or dipropionates, alpha sulpho-fatty acid salts, dipicolinic acid salts, oxidised polysaccharides, polyhydroxysulphonates, silicates, and mixtures thereof. Specific examples of builders include sodium and potassium tripolyphosphate, phosphates, and hexametaphosphates. Ammonium or substituted ammonium, e.g., triethanol ammonium, salts of these materials, can also be used. Other specific examples of suitable salts are sodium sodium sesquicarbonate, sodium carbonate, sodium tetraborate, sodium and potassium pyrophosphate, and sodium and ammonium bicarbonate. The preferred alkaline builders according to this invention are the alkali metal phosphates, carbonates, silicates, polyphosphates and sesquicarbonates. Most preferred are sodium tripolyphosphate, trisodium phosphate, sodium sesquicarbonate, and mixtures thereof.

Suitable organic alkaline builder salts used in this invention (alone or in admixture) are alkali metal, ammonium or substituted ammonium aminocarboxylates: for example, sodium and potassium ethylene diamine tetraacetate, sodium and potassium N-(2-hydroxyethyl)-ethylene and diamine triacetates, sodium and potassium nitrilotriacetates and sodium, potassium and triethyl ammonium N-(2-hydroxyethyl)-nitrilodiacetates. The alkali metal, ammonium and alkanol ammonium salts of citric acid can be suitably employed. The alkali metal salts of phytic acid, for example, the sodium salts thereof, are also suitable as organic alkali sequestant builder salts.

Polyphosphonates are also valuable builders in terms of the present invention, including specifically sodium and potassium salts of ethane-1-hydroxy-1,1-diphosphonic acid, sodium and potassium salts of methylene diphosphonic acid, and sodium and potassium salts of ethane-1,1,2-triphosphonic acid. Other examples include the alkali metal salts of ethane-2-carboxy-1,1-diphosphonic acid, hydroxy methane diphosphonic acid, carbonyl diphosphonic acid, ethane-1-hydroxy-1, 1,2-triphosphonic acid, ethane-1-hydroxy-1,1,2-triphosphonic acid, propane-1,1,3,3-tetraphosphonic acid, propane-1,1,2,3-tetraphosphonic acid, and propane-1,2,2,3-tetraphosphonic acid.

The useful builders can be formulated to provide either phosphate-containing or phosphate-free cleaning compositions, although phosphate-containing compositions are preferred from the standpoint of soil removal.

Other examples of suitable alkaline detergency builders include those described in U.S. Pat. No. 3,309,319, at Col. 4, line 44 through Col. 5, line 9. The disclosure of this patent is hereby incorporated herein by reference.

Optional components

The formulations of the invention may include ammonium and alkali metal salts of fatty acids, such as, for example, mono- or diethanolammonium, sodium and potassium salts of coconut fatty acids.

Cosolvents that can be used include $C_{1-6}$ alcohols and $C_{3-24}$ alkylene glycol ethers such as, for example, butoxypropoxypropanol, butyl diglycol (Butyl Carbitol®), hexyl diglycol (Hexyl Carbitol®), butyl triglycol, and mixtures thereof. The level of cosolvent is typically from about 0.2%, to about 20%, preferably from about 1% to about 15%, more preferably from about 2% to about 10%.

Generally the solvents suitable for use herein may be selected from the group consisting of aromatic hydrocarbons having from about 6 to 12 carbon atoms in the aromatic portions, straight or branched chain hydrocarbons having from about 10 to 11 carbon atoms, alkylene glycols having from about 2 to 6 carbon atoms, straight or branched chain lower alkyl alcohols, glycerol, propylene carbonate, alkylene glycol mono alkyl ethers where the alkylene portion has from about 2 to 6 carbon atoms and the alkyl portion has about 1 to 6 carbon atoms, poly alkylene glycol mono alkyl ethers where each alkylene portion has from about 2 to 6 carbon atoms and the alkyl portion has about 1 to 6 carbon atoms, alkyl acetates where the alkyl portion has from about 1 to 6 carbon atoms, pine oil, terpenes and mixtures thereof. Examples of such solvents are the following:

| | |
|---|---|
| Dodecane | Propylene Carbonate |
| Toluene | Ethylene glycol monoethyl ether |
| Naphthalene | Diethylene glycol mono-n-butyl ether |
| Isopropyl Alcohol | Butyl acetate |
| Glycerol | Pine Oil |
| Hexylene Glycol | Orange Terpene |

Germicides may be incorporated into the compositions of the invention when the cleaner is intended for certain applications, such as cleaning bathroom tiles. Illustrative germicides are described in U.S. Pat. No. 3,882,038.

In the antimicrobial or disinfectant formulations, the purpose of the quaternary ammonium disinfectants is to reduce the rate of reproduction of or kill on contact gram positive and gram negative organisms the organisms encountered in, for example, kitchen environments. These disinfectants are also useful effective in killing molds, yeasts, and fungi. Useful such disinfectants include BTC 8358 which is N-alkyl (50% $C_{14}$, 40% $C_{12}$, and 10% $C_{16}$) dimethyl benzyl ammonium chloride, commercially available from Stepan Company, Northfield, Ill. Other quarternary ammonium compounds may be any of the well-known class of quaternary ammonium germicides characterized by the formula:

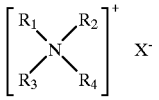

wherein at least one of the radicals, $R_1$, $R_2$, $R_3$ and $R_4$ ("the 'R' groups") is a hydrophobic, aliphatic, aryl aliphatic, or aliphatic aryl radical of from 6 to 26 carbon atoms, the entire cation portion of the molecule has a molecular weight of at least 165, and the remaining R groups are hydrophobic, aliphatic, aryl aliphatic, or aliphatic aryl radical of from 6 to 26 carbon atoms. The hydrophobic radicals may be long-chain alkyl, long-chain alkoxy aryl, long-chain alkyl aryl, halogen-substituted long-chain alkyl aryl, long-chain alkyl phenoxy alkyl, aryl alkyl, and so forth, in nature. The remaining radicals on the nitrogen atom other than the hydrophobic radicals are substituents of hydrocarbon structure usually containing a total of no more than 12 carbon atoms. The radical X in the above formula is any salt-forming anionic radical.

Suitable quaternary ammonium compounds within the above description include the alkyl ammonium halides such as cetyl trimethyl ammonium bromide, alkyl aryl ammonium halides such as octadecyl dimethyl benzyl ammonium bromide, N-alkyl pyridinium halides such as N-cetyl pyridinium bromide, and the like. Other suitable types of quaternary ammonium salts include those in which the molecule contains either, amide or ester linkages such a octyl phenoxy ethoxy ethyl dimethyl benzyl ammonium chloride. N-(laurylcocoaminoformylmethyl)—pyridinium chloride, and so forth. Other very effective types of quaternary ammonium germicides are those in which the hydrophobic radical is characterized by a substituted aromatic nucleus as in the case of lauryloxyphenyltrimethyl ammonium chloride, cetylaminophenyl-trimethyl ammonium methosulfate, dodecylphenyl-trimethyl ammonium methosulfate, dodecylbenzltrimethyl ammonium chloride, chlorinated dodecylbenzyltrimethyl ammonium chloride, and the like.

Preferred quaternary ammonium germicides of the above general types are the long-chain alkyl dimethylbenzyl quaternary ammonium salts, the alkyl phenoxy alkoxy alkyl dimethyl benzyl quaternary ammonium salts, the N-(acylcocoaminoformylmethyl)pyridinium halides, the long-chain alkyl trimethyl ammonium halides, the long-chain alkyl benzyl dimethyl benzyl ammonium halides, and the long-chain alkyl benzyl diethyl ethanol ammonium halides in which the alkyl radical contains from 8–18 carbon atoms.

Still other, illustrative of suitable quaternary ammonium germicides are: dioctyl dimethyl ammonium chloride, octyl decyl dimethyl ammonium chloride, didecyl dimethyl ammonium chloride, ($C_{12}$–$C_{18}$) n-alkyl dimethyl benzyl ammonium chloride, ($C_{12}$–$C_{18}$) n-alkyl dimethyl ethylbenzyl ammonium chloride, and ($C_{12}$–$C_{18}$) n-alkyl dimethyl benzyl ammonium saccharinate. This is not an exhaustive list and other quaternary ammonium salts having germicidal activity will suffice. The quaternary ammonium salt in the present invention need not be a single entity, but may be a blend of two or more quaternary ammonium salts. The amount, in weight-percent, of the quaternary ammonium salt, either as a single entity or blended, is typically from about 0.1%–2.0%. The preferred quaternary ammonium germicide is a mixture of about 34% by weight $C_{12}$ and 16% by weight $C_{14}$ n-alkyl dimethyl ethylbenzyl ammonium chloride and about 30% by weight $C_{14}$, 15% by weight $C_{16}$, 2.5% by weight $C_{12}$ and 2.5% by weight $C_{18}$ n-alkyl dimethyl benzyl ammonium chloride.

Other optional components include from about 0.01–10% by weight of monoalkylamines having 1 to 4 carbon atoms, dialkylamines having 1 to 4 carbon atoms in each alkyl, trialkylamines having 1 to 4 carbon atoms in each alkyl group, mono-, di- and trialkanolamines having 2 to 4 carbon atoms in each alkyl group, cycloalkylamines and morpholine.

In many applications it will be highly desirable to incorporate a suds suppressor as an optional ingredient in the aqueous liquid cleaners herein. The purpose of this ingredient is to eliminate the need to repetitively rinse a surface after it is washed in order to remove all visible traces of the surfactant. The composition should contain about 1–3% of the suds suppressor, if it is used. One example of a suitable suds suppressor is a surfactant which is the condensation product of a straight-chain random secondary alcohol having a chain length of from about 11 to about 15 carbon atoms and having an average length of from about 12 to about 15 carbon atoms with from about 0 to about 3 moles of ethylene oxide. There is a definite relationship between the amount of primary surfactant and the amount of the suds suppressor which should be used. There is from about 1% to about 3%, preferably from about 1% to about 2% of the suds suppressor in the composition, and the ratio of primary surfactant to suds suppressor ranges from about 4:1 to about 0.7:1, preferably from about 2:1 to about 1:1, and most preferably from about 1.5:1 to about 1:1.

All documents, e.g., patents and journal articles, cited above or below are hereby incorporated by reference in their entirety.

One skilled in the art will recognize that modifications may be made in the present invention without deviating from the spirit or scope of the invention. The invention is illustrated further by the following examples which are not to be construed as limiting the invention or scope of the specific procedures described herein.

In the following examples, all amounts are stated in percent by weight of active material unless indicated otherwise.

In certain examples herein, the following names are used to define the components of the formulations:

| | |
|---|---|
| Ninol 11-CM | Modified cocodiethanolamide |
| Bio-Terge PAS-8S | Sodium Octane Sulfonate |
| $Na_4$EDTA | Sodium ethylenediamine tetra acetate |
| Amidox C-5 | Ethoxylated Cocomonoethanolamide (5EO) |
| Stepanate SXS | Sodium xylene sulfonate |
| Polystep B-29 | Sodium octyl sulfate |
| SME MC-48 | Sodium salt of α-sulfonated methyl cocoate |
| Ninol 1301 | Ethoxylated alkanolamide (5EO) |
| BTC 885 | Quaternary ammonium compound sold by Stepan Company, Northfield, Illinois |

Method of preparation

The compositions are simply prepared by combining at room temperature all of the ingredients, optionally, with an appropriate amount of water. The compositions may be dry powders, aqueous systems, or formulated in an organic solvent.

Assay for Quantitation of Residue Visible as Filming and Streaking

Ten drops of a formulation to be evaluated (at a concentration of from about 2–4% solids by weight) are placed on a black ceramic tile measuring 4.5×4.5 inches. Ten scrub cycles are executed by hand using a soft paper tissue. The tile is allowed to dry for ten minutes. Any visible residue on the tile is then rated visually using a scale of 1 (much filming and/or streaking) to 10 (no visible filming and/or streaking).

Examples

| | Formulation No. | | | |
|---|---|---|---|---|
| | 1 | 2 | 3 | 4 |
| Propylene glycol propyl ether | 1.54 | 1.54 | 1.54 | 1.54 |
| Modified cocodiethanol amide | 1.03 | 1.03 | 1.03 | 1.03 |
| Sodium ethylenediamine tetraacetate | 1.02 | 1.02 | 1.02 | 1.02 |
| sodium xylene sulfonate | 0.7 | | | |
| $C_8$ alkyl sulfonate | | 0.7 | | |
| $C_8$ alkyl sulfate | | | 1.4 | |
| $C_9$ alcohol ether sulfate (1 mole of ethylene oxide) | | | | 1.4 |
| Deionized water | | q.s. to 100 | | |
| Filming/streaking value | 9.0 | 9.0 | 6.0 | 6.5 |

| | Formulation No. | | |
|---|---|---|---|
| | 4A | 4B | 4C |
| Ethylene glycol n-butyl ether | 1.54 | 1.54 | 1.54 |
| Ninol 11-CM | 1.03 | 1.03 | 1.03 |
| Bio-Terge PAS-8S | 1.4 | 1.4 | 1.4 |
| $Na_4$ EDTA | 1.02 | | 0.61 |
| Na Citrate | | 1.02 | |
| Na Metasilicate-$5H_2O$ | | | 0.41 |
| Deionized water | Q.S. to 100 | Q.S. to 100 | Q.S. to 100 |
| Total Concentration | 5.0 | 5.0 | 5.0 |
| Filming/streaking value | 8.0 | 7.6 | 7.8 |

| | Formulation No. | |
|---|---|---|
| | 4D | 4E |
| Propylene glycol n-butyl ether | 1.54 | 1.54 |
| Amidox C-5 | 1.03 | 1.03 |
| $Na_4$ EDTA | 1.02 | 1.02 |
| Stepanate SXS | 1.4 | |
| Bio-Terge PAS-8S | | 1.4 |
| deionized water | q.s. to 100 | |
| Filming/streaking value | 9.0 | 9.0 |

| | Formulation No. | | |
|---|---|---|---|
| | 5 | 6 | 7 |
| Propylene glycol n-propyl ether | 5.5 | 3.0 | |
| $C_{13.6}$ sulfonated methyl ester | 3.7 | 3.7 | 5.0 |
| $C_6/C_8$ alkyl sulfonate | 5.0 | 5.0 | 6.5 |
| sodium citrate | 1.8 | 1.8 | 1.8 |
| deionized water | q.s. to 100% | q.s. to 100% | q.s. to 100% |
| total concentration % | 16.0 | 13.5 | 13.5 |
| pH | 6.54 | 6.54 | 6.42 |

| | Formulation No. | | | |
|---|---|---|---|---|
| | 8 | 9 | 10 | 11 |
| Ninol 11-CM | 1.77 | 1.77 | | |
| Bio-Terge PAS-8S | 1.71 | 1.71 | | |
| $Na_4$ EDTA | 0.88 | 1.32 | 1.0 | 1.0 |
| NaOH | | 0.1–0.13 | | |
| Na Metasilicate•$5H_2O$ | 0.44 | | | |

-continued

| | Examples | | | |
|---|---|---|---|---|
| Ethylene glycol n-butyl ether | | | 1.54 | 1.54 |
| Amidox C-5 | | | 1.03 | |
| Ninol 1301 | | | | 1.03 |
| $C_8$ Amine oxide | | | 1.4 | 1.4 |
| Deionized water | Q.S. to 100 | Q.S. to 100 | Q.S. to 100 | Q.S. to 100 |
| Total Concentration | 4.8 | 4.9 | 5.0 | 5.0 |
| Filming/streaking value | 6.6 | 6.8 | 7.5 | 7.0 |

| | Formulation 12 |
|---|---|
| Lauryl amine oxide | 1.50 |
| Alkylpolyglucoside having average of 10.3 carbons in alkyl portion | 1.50 |
| $Na_4$ EDTA | 0.50 |
| BTC 885 | 0.11 |
| Deionized water | q.s. to 100 |
| Filming/streaking value | 8 |

The improvement offered by an effective amount of hydrotrope according to the invention with various surfactant systems is demonstrated in FIG. 1. Aqueous hard surface cleaner formulations were prepared to contain, by weight of the formulation, 1.54% organic glycol ether solvent, 1.03% detergent surfactant, 0.5% detergent builder (sodium citrate), either with or without sufficient hydrotrope (sodium xylene sulfonate). These formulations were evaluated visually as described above.

| Comparative Examples | Formulation | |
|---|---|---|
| | A | B |
| Sodium $C_{12-14}$ alkyl benzene sulfonate | 2.0 | 3.0 |
| Coconut fatty acid | 1.0 | 0.5 |
| Sodium Carbonate | 1.5 | 2.0 |
| Sodim Bicarbonate | 1.0 | 2.0 |
| Tetrapotassium pyrophosphate | 11.0 | |
| Sodium citrate | | 8.0 |
| Sodium sulfate | 0.2 | 0.2 |
| Sodium cumene sulfonate | 6.0 | 5.0 |
| $NH_4OH$ | 1.0 | 1.0 |
| Butoxy-n-propanol | 5.0 | 2.0 |
| Butoxypropoxypropanol | 5.0 | |
| Butyl carbitol | | 9.5 |
| water (deionized) | 66.3 | 66.8 |
| ratio of weight of hydrotrope to remaining solids | 1:2.95 | 1:3.34 |
| hydrotrope to weight of builder | 1:2.28 | 1:2.44 |

Formulations A and B were evaluated as described above. Both formulations yielded severe filming/streaking; values of less than 1 were obtained with each. Each of these formulations was subsequently diluted 1:10 with deionized water and evaluated. Formulation A was thus diluted to 3.37% and B to 3.32% of solids by weight. After dilution, Formulations A and B yielded filming/streaking values of 3 and 4 respectively.

To each of Formulations A and B was added an additional 3% by weight of sodium cumene sulfonate (SCS); the resulting formulations (C and D in the table below) were diluted 1:10 with deionized water, and evaluated. Formulation A with 3% additional SCS (Formulation C) yielded a value of 7 in the filming/streaking test while Formulation B with 3% additional SCS (Formulation D) yielded a value of 8.

| | Formulation | |
|---|---|---|
| | C | D |
| Sodium $C_{12-14}$ alkyl benzene sulfonate | 2.0 | 3.0 |
| Coconut fatty acid | 1.0 | 0.5 |
| Sodium Carbonate | 1.5 | 2.0 |
| Sodim Bicarbonate | 1.0 | 2.0 |
| Tetrapotassium pyrophosphate | 11.0 | |
| Sodium citrate | | 8.0 |
| Sodium sulfate | 0.2 | 0.2 |
| Sodium cumene sulfonate | 9.0 | 8.0 |
| $NH_4OH$ | 1.0 | 1.0 |
| Butoxy-n-propanol | 5.0 | 2.0 |
| Butoxypropoxypropanol | 5.0 | |
| Butyl carbitol | | 9.5 |
| water (deionized) | 66.3 | 66.8 |
| ratio of weight of hydrotrope to remaining solids | 1:1.96 | 1:2.0 |
| hydrotrope to weight of builder | 1:1.5 | 1:1.5 |

| Comparative Examples | Formulation C |
|---|---|
| Ethylene glycol n-butyl ether | 1.54 |
| Ninol 11-CM | 1.03 |
| Sodium ethylenediamine tetraacetate | 1.02 |
| deionized water | q.s. to 100 |
| Filming/streaking value | 1.4 |

From the foregoing it will be appreciated that, although specific embodiments of the invention have been described herein for purposes of illustration, various modifications may be made without deviating from the spirit and scope of the invention.

What is claimed is:

1. In a composition for cleaning hard surfaces comprising at least one detergent surfactant and at least one detergent builder where the composition is free from organic solvents, the improvement comprising a hydrotrope in a ratio of the weight of hydrotrope to the weight of solids exclusive of hydrotrope of about at least about 1:3.5 and wherein the ratio of the weight of hydrotrope to the weight of builder is about 1:1.8 to 4:1.

2. A composition according to claim 1, wherein the ratio of the weight of hydrotrope to the weight of all solids exclusive of builder is about 1:3.5 to 4:1.

3. A composition according to claim 2, wherein the hydrotrope is selected from the group consisting of benzene sulfonates, naphthalene sulfonates, short chain alkyl benzene sulfonates, medium chain ($C_{6-8}$) alkyl sulfonates, alkylpolyglucosides, medium chain ($C_6$–$C_{10}$) alkyl dimethyl amine oxides, alkyl diphenyloxide disulfonates, and phosphate ester hydrotropes.

4. A composition according to claim 2, wherein the hydrotrope is a xylene sulfonate, an alkyl sulfonate having an average of from about 6–8 carbon atoms in the alkyl portion, or an alkylpolyglycoside having an average of about 10 carbon atoms in the alkyl portion.

5. A method for preparing a hard surface cleaner composition capable of cleaning a hard surface substantially without providing the surface with a residue visible as a film or streaks comprising:

(a) preparing an aqueous detergent base comprising at least one surfactant and at least one builder where the detergent base is free from organic solvents; and (b) adding to the aqueous base a hydrotrope in a ratio of the weight of hydrotrope to the combined weight of other solids of at least about 1:3.5.

6. A method according to claim 5, wherein the hydrotrope is a xylene sulfonate, an alkyl sulfonate having from an average of about 6–8 carbon atoms in the alkyl portion, or an alkylpolyglycoside having an average of about 10 carbon atoms in the alkyl portion.

7. A hard surface cleaning composition according to claim 1, where the composition comprises from about 0.01–5% by weight of a quaternary ammonium germicide, from about 0.5 to 5% by weight of an alkyl polyglucoside, and from about 0.5 to 5% by weight of a $C_{10-16}$ amine oxide.

8. A composition according to claim 7, wherein the composition further comprises ethylenediamine tetraacetate.

9. A composition according to claim 2, wherein the hydrotrope is an alkylpolyglucoside having an average of about 10 carbon atoms in the alkyl portion.

10. A liquid hard-surface cleaning composition free from organic solvents and comprising:

(a) from 0.1% to 40% of an anionic detergent surfactant selected from the group consisting of salts linear alkyl benzene sulfonic acid, salts of coconut alkyl ether sulfate containing 3 moles of ethylene oxide, mono-salts of alpha-sulfonated alkyl esters of fatty acids; di-salts alpha-sulfonated alkyl esters of fatty acids, the sodium and potassium salts of coconut fatty acids, zwitterionic surfactants, betaine surfactants, sulfobetaine surfactants, and mixtures thereof;

(b) a hydrotrope selected from the group consisting of benzene sulfonates, xylene sulfonates, naphthalene sulfonates, short chain alkyl benzene sulfonates, medium chain (C6-8) alkyl sulfonates, medium chain (C6-C11) alkyl sulfates, medium chain (C6-C10) alkyl dimethyl amine oxides, and alkyl diphenyloxide disulfonates, medium chain ($C_{6-11}$) alkyl ether (up to 10 moles of ethylene oxide) sulfates, polymeric hydrotropes, an alkylpolyglycoside having an average of about 10 carbon atoms in the alkyl portion, and mixtures thereof;

(c) from 0.01% to 30% of a deterrent builder; and (d) the balance water;

the amount of hydrotrope producing a weight ratio of hydrotrope to solids exclusive of hydrotrope of at least 1:3.5; and wherein the ratio of hydrotrope to detergent builder is from 1:1.8 to 4:1.

11. A liquid hard-surface cleaning composition according to claim 10, where the detergent builder selected from the group consisting of alkali metal carbonates, borates, pyrophosphates, orthophosphates, polyphosphates, phosphonates, bicarbonates, polyacetates, carboxylates, polycarboxylates, polyacetyl carboxylates, carboxymethyloxysuccinates, carboxymethyloxymalonates, ethylene diamine-N,N-discuccinic acid salts, polyepoxysuccinates, oxydiacetates, triethylene tetramine hexacetic acid salts, N-alkyl imino diacetates or dipropionates, alpha sulpho-fatty acid salts, dipicolinic acid salts, oxidised polysacchararides, polyhydroxysulphonates, silicates; sodium, potassium, ammonium, substituted ammonium tripolyphosphate, phosphates, and hexametaphosphates; sodium sesquicarbonate, sodium carbonate, sodium tetraborate, sodium and potassium pyrophosphate; sodium and ammonium bicarbonate; alkali metal, ammonium or substituted ammonium aminocarboxylates; sodium and potassium ethylene diamine tetraacetate; sodium and potassium N-(2-hydroxyethyl)-ethylene and diamine triacetates; sodium and potassium nitrilotriacetates; sodium, potassium and triethyl ammonium N-(2-hydroxyethyl)-nitrilodiacetates; alkali metal, ammonium and alkanol ammonium salts of citric acid; alkali metal salts of phytic acid; polyphosphonates; sodium and potassium salts of ethane-1-hydroxy-1,1-diphosphonic acid; sodium and potassium salts of methylene diphosphonic acid; sodium and potassium salts of ethane-1,1,2-triphosphonic acid; alkali metal salts of ethane-2-carboxy-1,1-diphosphonic acid; hydroxy methane diphosphonic acid; carbonyl diphosphonic acid; ethane-1-hydroxy-1, 1,2-triphosphonic acid; ethane-1-hydroxy-1,1,2-triphosphonic acid; propane-1,1,3,3-tetraphosphonic acid; propane-1,1,2,3-tetraphosphonic acid; and propane-1,2,2,3-tetraphosphonic acid; or water-soluble salts of polycarboxylate polymers and copolymers; or mixtures thereof.

12. A low-filming, low-streaking aqueous liquid hard-surface cleaning composition according to claim 11, wherein the amount of the surfactant is from about 1% to 10% by weight and the amount of the detergent builder is from about 0% to 20% by weight.

13. A liquid hard-surface cleaning composition according to claim 12, wherein the amount of surfactant in the composition is from about 2% to 5% by weight of the composition.

14. A method for cleaning and disinfecting a soiled hard surface, comprising contacting the soiled hard surface for a sufficient time to remove at least part of the soil therefrom with a liquid hard-surface cleaning composition according to claim 10.

15. An aqueous liquid hard-surface cleaning composition free from organic solvents and comprising:

(a) from about 1 to 10 weight % of a detergent surfactant selected from sodium linear alkyl benzene sulfonate (LAS);

salts of coconut alkyl ether sulfate containing 3 moles of ethylene oxide;

the adducts of primary, secondary, and tertiary alcohols having a range of alkyl chain lengths of from 11 to 15 carbon atoms and an average of 2 to 12 ethylene oxide moieties; the sodium and potassium salts of coconut fatty acids (coconut soaps);

condensation products of a straight or branched chain alcohol containing from about 8 carbons to about 16 carbon atoms and having an average carbon chain length of from about 8 to about 12 carbon atoms with from about 2 to about 8 moles of ethylene oxide per mole of alcohol;

an amide having the formula:

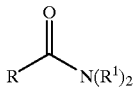

wherein R is a straight-chain alkyl group containing from about 7 to about 15 carbon atoms and having an average carbon chain length of from about 9 to about 13 carbon atoms and wherein each $R^1$ is a hydroxy alkyl group containing from 1 to about 3 carbon atoms or a hydroxyalkyl group ethoxylated with up to about 6 moles of ethylene oxide;

zwitterionic surfactants; or
phosphine oxide surfactants;
or mixtures thereof;

(b) a hydrotrope selected from the group consisting of benzene sulfonates, xylene sulfonates, naphthalene sulfonates, short chain alkyl benzene sulfonates, medium chain ($C_{6-8}$) alkyl sulfonates, medium chain ($C_6$–$C_{10}$) alkyl dimethyl amine oxides, and alkyl diphenyloxide disulfonates;

(c) from 0.01% to 30% of a detergent builder; and (d) the balance water;

the amount of hydrotrope producing a weight ratio of hydrotrope to solids exclusive of hydrotrope of at least about 1:3.5; and wherein the ratio of hydrotrope to detergent builder is from 1:1.8 to 4:1.

* * * * *

UNITED STATES PATENT AND TRADEMARK OFFICE

CERTIFICATE OF CORRECTION

PATENT NO. : 6,281,178 B1
DATED : August 28, 2001
INVENTOR(S) : Rykin et al.

It is certified that error appears in the above-identified patent and that said Letters Patent is hereby corrected as shown below:

Column 15,
Line 46, the word “deterrent” has been changed to -- detergent --
Line 64, the word “polysacchararides” has been changed to -- polysaccharides --

Signed and Sealed this

Fifth Day of October, 2004

JON W. DUDAS
*Director of the United States Patent and Trademark Office*